United States Patent [19]

Papiernik

[11] Patent Number: 4,821,323

[45] Date of Patent: Apr. 11, 1989

[54] STEREO HEADPHONE

[76] Inventor: Raymond S. Papiernik, 1441 Fairway Apt. 102, Naperville, Ill. 60540

[21] Appl. No.: 157,710

[22] Filed: Feb. 19, 1988

[51] Int. Cl.[4] ..... H04R 5/02

[52] U.S. Cl. ..... 381/25; 381/183; 381/181; 381/187; 381/68.3

[58] Field of Search ..... 381/25, 182, 183, 187, 381/188, 184, 68.3, 18

[56] References Cited

U.S. PATENT DOCUMENTS

| | | | |
|---|---|---|---|
| D. 203,445 | 1/1966 | Bowell | D14/36 |
| 1,809,349 | 6/1931 | Moore | 381/183 |
| 3,125,646 | 3/1964 | Lewis | 381/68.3 |
| 3,263,032 | 7/1966 | Scanlon | D14/36 |
| 3,272,926 | 9/1966 | Falkenberg | D14/36 |
| 3,547,219 | 12/1970 | Bothos | D14/36 |
| 3,629,521 | 12/1971 | Puharich et al. | 381/68.3 |
| 3,863,028 | 1/1975 | Fixler | 381/25 |
| 3,984,885 | 10/1976 | Yoshimura et al. | 381/25 |
| 4,297,535 | 10/1981 | Hehemann | 381/183 |
| 4,551,584 | 11/1985 | Mathiasen | D14/36 |
| 4,571,746 | 2/1986 | Görike | 381/25 |

FOREIGN PATENT DOCUMENTS

| | | | |
|---|---|---|---|
| 2854854 | 7/1980 | France | 381/183 |

*Primary Examiner*—Forester W. Isen

*Attorney, Agent, or Firm*—Jerry T. Kearns

[57] ABSTRACT

A stereo headphone has a generally "U"-shaped head band provided with a pair of head band support rails at opposite ends thereof. End portions of the head band are received for sliding extension and retraction withing the support rails. A speaker support frame is secured to each of the support rails. A conventional speaker is mounted within each of the support frames. A pair of mounting bars are connected to each of the speaker support frames. An adjustable linkage allows compound adjustment of the mounting bars with respect to the support frames. A vibrational audio output disc is provided on an end portion of each of the mounting bars. A switch on each of the support frames allows selective actuation of each of the speakers. In use, the speakers of the headphones are received over the ears of a user in a conventional fashion. The vibrational audio output discs are then positioned by virtue of the compound adjustment linkage adjacent the temples of the user. This secondary vibrational audio output provides an enhanced listening effect.

6 Claims, 3 Drawing Sheets

STEREO HEADPHONE

BACKGROUND OF THE INVENTION

1. Field of the Invention

The present invention relates to headphones, and more particularly pertains to a new and improved stereo headphone which provides a pair of vibrational audio output discs adapted to rest against the temples of a user. In a concert hall listening environment, an individual receives sound waves not only through their ears, but also through vibration of the bones and other tissues of their head which transmits secondary sound waves to their audio nerves. Conventional stereo headphones transmit sound waves only adjacent to the ears of an individual. While modern stereo headphones provide a full audio frequency response range, these headphones do not simulate the secondary sound transmission experienced in a concert hall environment. In order to overcome this disadvantage and to provide an enhanced listening experience, the present invention utilizes a pair of secondary vibrational audio output discs which rests against the temples of a user, and transmit audio vibrational signals through the bones and tissues of the individual.

2. Description of the Prior Art

Various types of headphones are known in the prior art. A typical example of such a headphone is to be found in U.S. Design Pat. No. 203,445, which issued to W. Bowell on Jan. 11, 1966. This patent discloses a sound transmitting headset which utilizes a pair of foam ear abutment discs interconnected by a "Y"-shaped linkage tubing. U.S. Pat. No. 3,263,032, which issued to E. Scanlon on July 26, 1966, discloses a stereo headphone which has a pair of speakers mounted for compound adjustment on a head band. U.S. Pat. No. 3,272,926, which issued to G. Falkenberg on Sept. 13, 1966, discloses a generally "U"-shaped head band having a pair of pivotally connected speakers. The head band is provided with telescopically extendable side portions for adapting the headphone for use by various individuals. Each speaker is formed as an ear receiving cup surrounded by a foam sound insulation ring. U.S. Pat. No. 3,547,219, which issued to C. Bothos on Dec. 15, 1970, discloses a stethoscope type headset provided with rotatable ear pieces permitting adjustment to the ear canal angles of the listener. The ear pieces are provided with amplifier cavities. A plug is utilized to connect hearing tubes attached to the ear pieces to a main sound supply outlet. U.S. Pat. No. 4,551,584, which issued to H. Mathiasen on Nov. 5, 1985, discloses a stereo headphone which is provided with a pair of temple pads adjacent the ear foam speaker units, whereby the pressure against the ear is relived by an additional holding pressure against the temple region. In order to be self adjustable for an optional pressure distribution, the earphone unit and the temple pad are mounted in each side, on a common carrier member, which is pivoted to the end of a resilient generally "U"-shaped head band about a pivot axis located between the earphone unit and the temple pad.

While the above mentioned devices are suited for their intended usage, none of these devices provide a stereo headphone having a pair of secondary audio vibrational output discs for abutment with the temple of a user for providing an enhanced concert hall acoustical effect. Inasmuch as the art is relatively crowded with respect to these various types of headphones, it can be appreciated that there is a continuing need for and interest in improvements to such headphones, and in this respect, the present invention addresses this need and interest.

SUMMARY OF THE INVENTION

In view of the foregoing disadvantages inherent in the known types of headphones now present in the prior art, the present invention provides an improved stereo headphone. As such, the general purpose of the present invention, which will be described subsequently in greater detail, is to provide a new and improved stereo headphone which has all the advantages of the prior art headphones and none of the disadvantages.

To attain this, a representative embodiment of the concepts of the present invention is illustrated in the drawings and makes use of a generally "U"-shaped head band provided with a pair of head band support rails at opposite ends thereof. End portions of the head band are received for sliding extension and retraction within the support rails. A speaker support frame is secured to each of the support rails. A conventional speaker is mounted within each of the support frames. A pair of mounting bars are connected to each of the speaker support frames. An adjustable linkage allows compound adjustment of the mounting bars with respect to the support frames. A vibrational audio output disc is provided on an end portion of each of the mounting bars. A switch on each of the support frames allows selective actuation of each of the speakers. In use, the speakers of the headphones are received over the ears of a user in a conventional fashion. The vibrational audio output discs are then positioned by virtue of the compound adjustment linkage adjacent the temples of the user. This secondary vibrational audio output provides an enhanced acoustical effect.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stereo headphone which has all the advantages of the prior art headphones and none of the disadvantages.

It is another object of the present invention to provide a new and improved stereo headphone which may be easily and efficiently manufactured and marketed.

It is a further object of the present invention to provide a new and improved stereo headphone which is of a durable and reliable construction.

An even further object of the present invention is to provide a new and improved stereo headphone which is susceptible of a low cost of manufacture with regard to both materials and labor, and which accordingly is then susceptible of low prices of sale to the consuming public, thereby making such headphones economically available to the buying public.

Still yet another object of the present invention is to provide a new and improved stereo headphone which provides in the apparatuses and methods of the prior art some of the advantages thereof, while simultaneously overcoming some of the disadvantages normally associated therewith.

Still another object of the present invention is to provide a new and improved stereo headphone which utilizes a pair of secondary audio vibrational output discs to provide an enhanced concert hall listening effect.

Yet another object of the present invention is to provide a new and improved stereo headphone having a pair of audio vibrational output discs having a compound adjustable mounting linkage for allowing the discs to be placed against the temples of a variety of individual users.

Even still another object of the present invention is to provide a new and improved stereo headphone which has a pair of audio vibrational output discs mounted adjacent a pair of speakers by a compound linkage for adjustable positioning against the temples of an individual user to provide a secondary vibrational sound transmission through the bones and facial tissues of an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
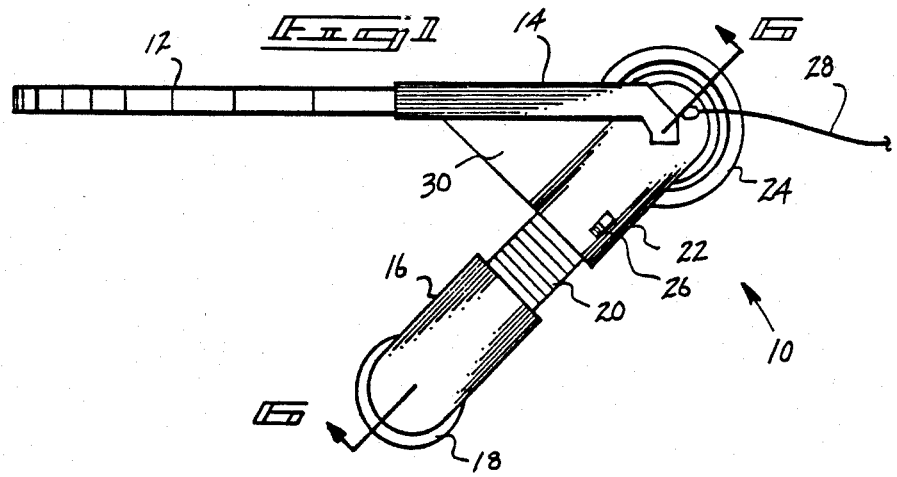
FIG. 1 is a side view of the stereo headphone of the present invention.

With reference now to the drawings, and in particular to FIG. 1 thereof, a new and improved stereo headphone embodying the principles and concepts of the present invention and generally designated by the reference numeral 10 will be described.

More specifically, it will be noted that the first embodiment 10 of the invention includes a generally "U"-shaped adjustable head band 12, having opposite ends received for sliding movement within hollow head band support rails 14. Hollow vibrational audio output mounting bars 16 are each provided with a vibrational audio output disc 18. The vibrational audio output discs 18 are conventional items formed from thin flat metallic discs. These devices are of the type utilized to provide audio effects in hand held computer games. While these discs 18 do not efficiently produce high fidelity audio output, they do produce a large vibrational output of the flat metallic discs, as compared with conventional headphone speakers. In use, this disc 18 will be pressed against the temple of a user, thus transmitting audio vibrations through the facial structures of the individual to the audio nerves. An adjustable linkage band 20 connects each of the mounting bars 16 for compound adjustment with respect to a speaker support frame 22. The details of the compound adjustable linkage 20 will be hereinafter described. At this point, it is sufficient to note that the adjustable linkage bands 20 allow the discs 18 to be placed against the temples of a variety of different individual users. A pair of conventional speakers 24 are mounted within the speaker support frames 22. These speakers 24 are adapted to be received over the ears of a user in conventional fashion. A switch 26 on each of the support frames 22 is connected to selectively activate and deactivate the associated speaker 24. A triangular connecting brace 30, formed from a transparent or colored plastic material, extends between the head band support rail 14 and the speaker support frame 22.

Figure 2:
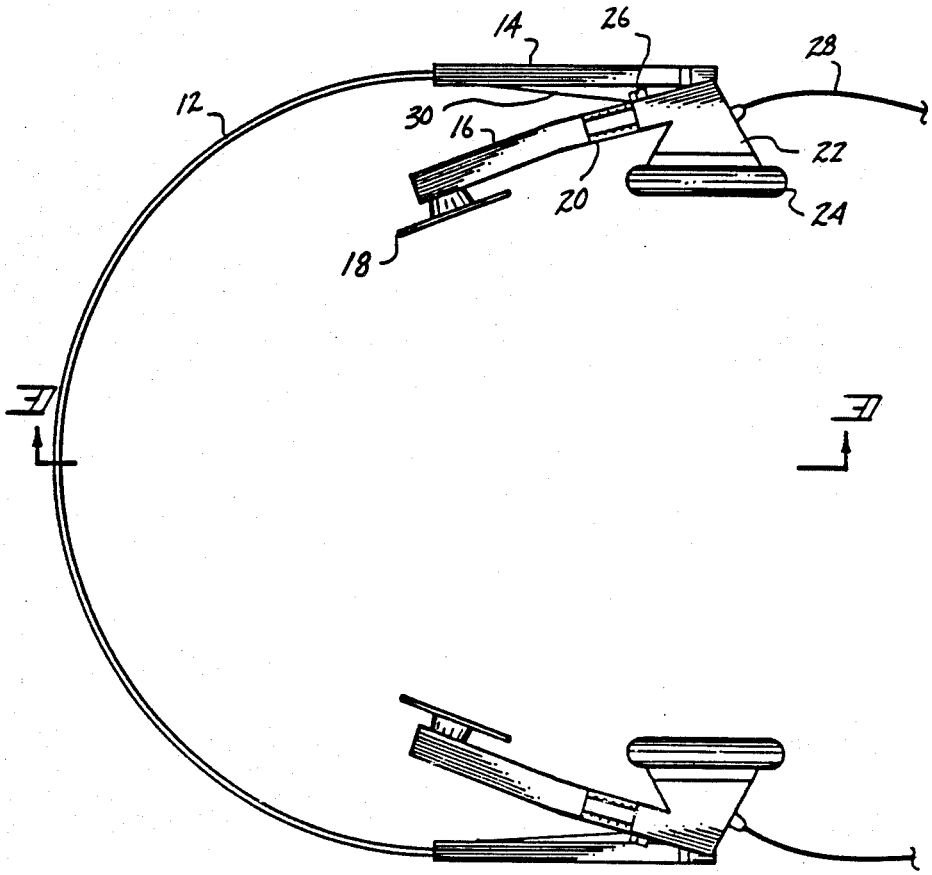
FIG. 2 is a front view of the stereo headphone of the present invention.

As shown in FIG. 2, the construction of the audio output assemblies on each end of the "U"-shaped band 12 are symmetric. An audio signal wire 28 extends from a conventional audio output source to each of the speaker support frames 22. The audio signal from each of the wires 28 is connected to both the speaker 24 and the vibrational audio output disc 18. A switch 26 allows each of the speakers 24 to be selectively actuated or deactuated, allowing an individual to choose the desired listening mode.

Figure 3:
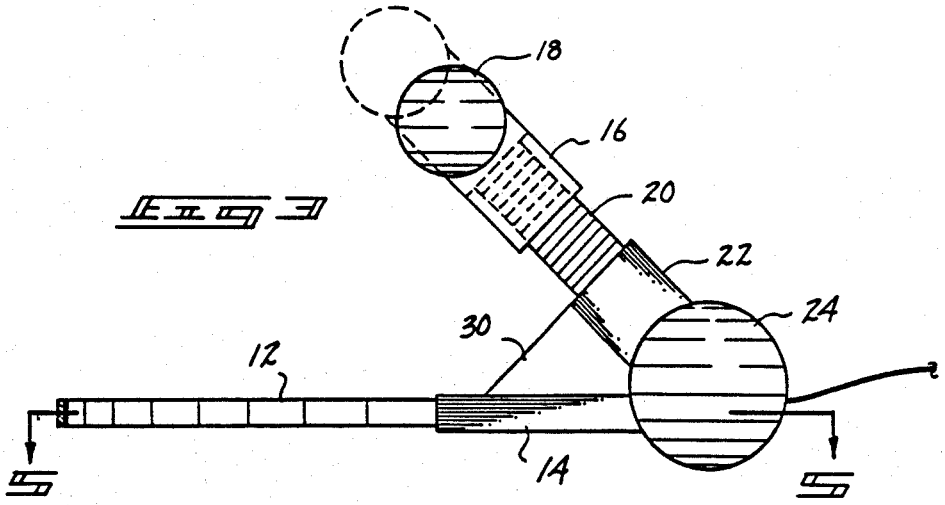
FIG. 3 is a cross sectional view taken along line 3—3 of FIG. 2.

As shown in FIG. 3, the adjustable linkage band 20 is received within the hollow mounting bar 16, allowing the mounting bar 16 to be selectively extended, as illustrated in dotted lines. The linkage band 20 also allows the mounting bar 16 to be bent inwardly and outwardly of the plane of the paper, allowing the disc 18 to be pressed against the temple of a user.

Figure 4:
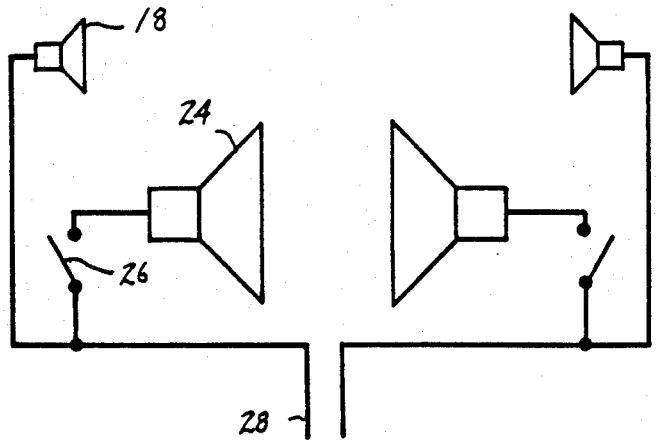
FIG. 4 is a schematic diagram illustrating the selective switch actuation of the speakers of the stereo headphone of the present invention.

In FIG. 4, a schematic diagram illustrates the electrical connection of the switch 26 and the speaker 24 and vibrational audio output disc 18. In the illustrated open position of the switches 26, the speakers 24 will be deactivated, thus providing a vibrational audio output mode of listening. By closing the switches 26, the speakers 24 will be activated, providing a combined listening mode.

Figure 5:
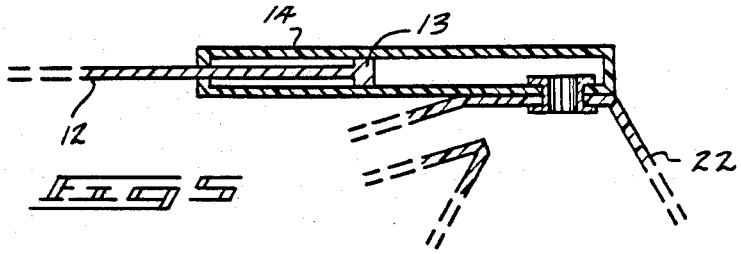
FIG. 5 is a cross sectional view, taken along line 5—5 of FIG. 3, illustrating the head band adjustment mechanism.

As shown in FIG. 5, an enlargement 13 on each end of the head band 12 is received for frictional sliding movement within the interior of the hollow head band support rail 14. This allows the head band 12 to be adjusted in size, depending upon the preferences and needs of an individual user.

Figure 6:
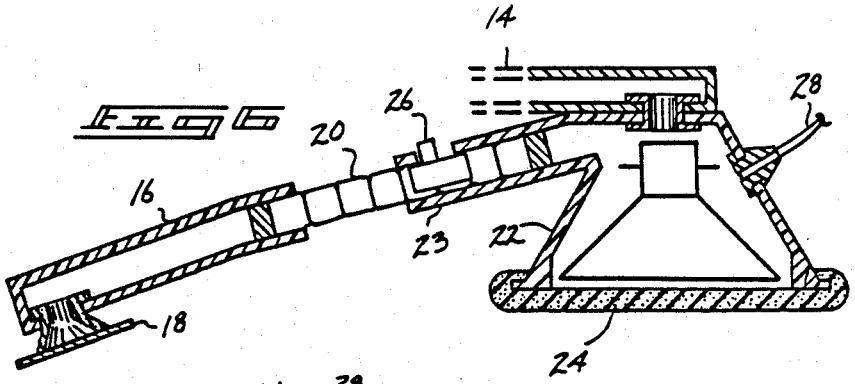
FIG. 6 is a cross sectional view, taken along line 6—6 of FIG. 1, illustrating the vibrational audio output disc compound adjustment mechanism.

As may be seen in the cross sectional view of FIG. 6, an extension 23 of the speaker mounting frame 22 extends at an acute angle thereto. The switch 26 is mounted within the hollow extension 23. The adjustable linkage band 20 is rigidly secured within the extension 23. An opposite end of the linkage band 20 is received for sliding movement within the interior of the hollow mounting bar 16. By sliding the mounting bar 16 along the linkage 20, the disc 18 may be moved toward or away from the speaker 24, depending upon the preferences of an individual user. The linkage band 20 is formed from a plurality of individual links which also allows the disc 18 to be moved radially inwardly and outwardly with respect to the head band support rail 14. These dual adjustment modes provide a compound adjustment mechanism which allows the disc 18 to be positioned adjacent the temple of any user.

Figure 7:
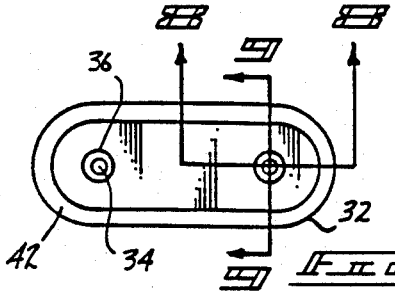
FIG. 7 is a top view of a link of the compound adjustable audio output disc linkage.

In FIG. 7, a top view of an individual link 32 of the linkage band 20 is provided. A pair of spaced cylindrical apertures 34 extend through the link 32. The link 32 has a generally oval configuration with a shoulder 42 formed at an intersection of stepped width portions of the link 32.

Figure 8:
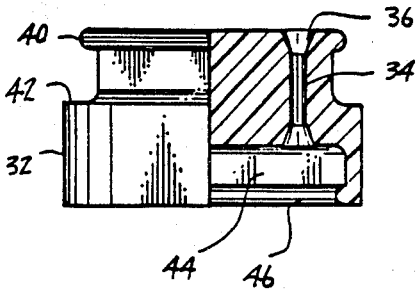
FIG. 8 is a cross sectional view, taken along line 8—8 of FIG. 7, illustrating the details of the link of FIG. 7.

As shown in the partial cross sectional view of FIG. 8, each of the links 32 has a reduced width upper portion provided with a radially outwardly extending radiused lip 40. A shoulder 42 is formed at the intersection of the reduced width upper portion with an increased width lower portion. An internal oval recess 44 is formed in a bottom surface of each of the links 32. The spaced recesses 34 extend from a top surface of each link and terminate at the recess 44. Each of the apertures 34 is provided with a pair of frusto conical portions 36, for a purpose to be described subsequently. A radially inwardly extending radiused lip 46 extends around the inner periphery of the recess 44, adjacent the bottom surface of the link 32.

Figure 9:
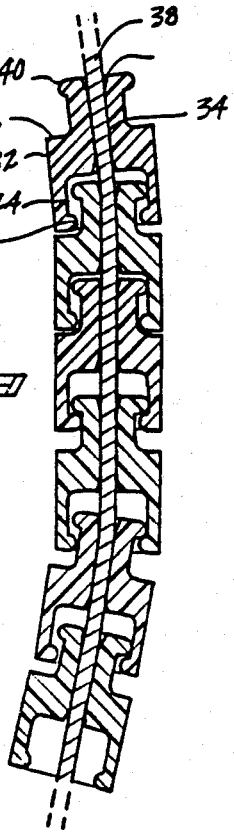
FIG. 9 is a cross sectional view illustrating the compound adjustment linkage of the audio vibrational output disc.

As shown in FIG. 9, a plurality of links 32 are connected together in interfitting relationship to form the linkage band 20. The reduced diameter upper portion of each link 32 is received within the oval recess 44 of an adjacent link 32. An audio signal wire 38 is threaded through the aligned apertures 34 in each of the links 32. A pair of the signal wires 38 extend through the spaced apertures 34 of the links 32 and provide audio signals to the vibrational audio output disc 18. The frusto conical portions 36 of the apertures 34 provide a clearance relief adjacent the wire 38, to prevent chaffing of the wire. By virtue of frictional engagement of the upper radial lip 40 of each link 32 within the oval recess 44 of an adjacent link 32, the linkage 20 may be positioned as desired by each individual user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved stereo headphone, comprising:

a generally "U"-shaped head band;

a pair of elongated hollow head band support rails;

opposite ends of said head band received for adjustable extension and retraction in said head band support rails;

a pair of speaker support frames, one of said speaker support frames secured to each of said head band support rails;

a pair of speakers, one of said speakers mounted on each of said speaker support frames;

each of said speaker support frames being inwardly inclined with respect to said head band support rails;

a pair of triangular transparent connecting braces, one of said connecting braces extending between each of said head band support rails and said speaker support frames;

a pair of vibrational audio output mounting bars, one of said mounting bars connected to each of said speaker support frames;

compound mounting means mounting each of said vibrational audio output mounting bars for compound adjustment with respect to said speaker support frame;

a pair of vibrational audio output discs, one of said vibrational audio output discs secured to each of said vibrational audio output mounting bars; and switch means on said headphone for selectively actuating said speakers.

2. The stereo headphone of claim 1, wherein said compound mounting means comprises a pair of adjustable linkage bands formed from a plurality of interconnected links, one end of each of said linkage bands received for sliding movement within one of said vibrational audio output mounting bars.

3. The stereo headphone of claim 2, wherein each of said links has a generally oval-shaped body portion having a stepped width.

4. The stereo headphone of claim 3, wherein each of said links has an upper reduced width portion with a radially outwardly extending radiused lip;

a lower increased width portion forming a shoulder at an intersection with said upper reduced width portion;

a generally oval recess formed in a bottom surface of each of said links;

a radially inwardly extending radiused lip formed in said recess; and a pair of spaced apertures extending through a top surface of said link, said apertures terminating in said recess.

5. The stereo headphone of claim 4, wherein said links are connected with said upper reduced width portion of each link received in said oval recess of an adjacent link.

6. The stereo headphone of claim 5, wherein a pair of signal wires for each of said vibrational audio output discs are threaded through said spaced apertures.

* * * * *